US008831491B2

(12) United States Patent
Ideguchi

(10) Patent No.: US 8,831,491 B2
(45) Date of Patent: Sep. 9, 2014

(54) IMAGE FORMING APPARATUS

(75) Inventor: Takuro Ideguchi, Munich (DE)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 13/253,233

(22) Filed: Oct. 5, 2011

(65) Prior Publication Data

US 2012/0099907 A1 Apr. 26, 2012

(30) Foreign Application Priority Data

Oct. 20, 2010 (JP) ..... 2010-235604

(51) Int. Cl.
*G03G 15/14* (2006.01)
*G03G 15/16* (2006.01)

(52) U.S. Cl.
CPC .... *G03G 15/1605* (2013.01); *G03G 2215/0129* (2013.01)
USPC ..... 399/315; 399/302; 399/303

(58) Field of Classification Search
USPC ..... 399/302–304, 308, 313, 315, 397
See application file for complete search history.

(56) References Cited

U.S. PATENT DOCUMENTS

| | | | | |
|---|---|---|---|---|
| 4,737,816 | A | 4/1988 | Inoue et al. | |
| 5,799,226 | A | 8/1998 | Shigeta et al. | |
| 5,923,938 | A | 7/1999 | Enomoto et al. | |
| 7,302,215 | B2 * | 11/2007 | Ahn et al. | 399/303 |
| 2006/0115304 | A1 | 6/2006 | Ahn et al. | |

FOREIGN PATENT DOCUMENTS

| | | | |
|---|---|---|---|
| CN | 1782900 | A | 6/2006 |
| EP | 1666979 | A1 | 6/2006 |
| JP | 63-164769 | U | 10/1988 |
| JP | 5-119636 | A | 5/1993 |
| JP | 8-113408 | A | 5/1996 |
| JP | 2010-169921 | A | 8/2010 |

OTHER PUBLICATIONS

Notification of Reasons for Refusal dated Oct. 9, 2012, in Japanese Application No. 2010-235604.
Combined Search and Examination Report Under Sections 17 and 18(3) dated Feb. 7, 2012, in GB Application No. GB1117697.1.
Chinese Office Action dated Dec. 3, 2013, in related Chinese Patent Application No. 201110319532.8 (with English translation).

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member; a stretched rotatable belt member; a transfer member for forming a transfer portion for permitting transfer of a toner image from the image bearing member onto a recording material carried on the belt member; a separation roller, capable of separating from the belt member the recording material carried on the belt member, for stretching the belt member; push-up device capable or locally pushing up a belt surface, with respect to a widthwise direction of the belt member, located upstream of the separation roller and downstream of the transfer portion with respect to a rotational direction of the belt member to separate from the belt member the recording material carried on the belt member; a pre-separation charging device, located downstream of the transfer portion and upstream of the push-up means with respect to the rotational direction of the belt member, for electrically charging the recording material by being supplied with a voltage of an identical polarity to a normal charge polarity of a toner; and an execution portion for executing an operation in a mode in which the recording material charged by the supply of the voltage to the pre-separation charging means is separated from the belt member by pushing up the belt member by the push-up device.

9 Claims, 10 Drawing Sheets

IMAGE FORMING APPARATUS

FIELD OF THE INVENTION AND RELATED ART

The present invention relates to a transfer technique, in which a toner image formed on an image bearing member is transferred onto a recording material by using an electrophotographic apparatus such as a copying machine or a laser beam printer. Further, the present invention relates to a separation technique for separating the recording material from a transfer belt for nip-conveying of the recording material.

In recent years, an image forming apparatus using an electrophotography, such as the copying machine or the laser beam printer has been required to meet various recording materials. As an object thereof, the image forming apparatus has been required to meet the recording material which has low rigidity such as thinner paper. However, with respect to such thin paper or the like has the low rigidity and therefore a recording material conveying method capable of further enhancing stability is required.

Therefore, the recording material conveying method is met by using a technique such that the recording material is electrostatically attracted to a transfer belt for nip-conveying the recording material.

However, in a technique in which the recording material is separated by curvature from the transfer belt by using a separation roller, in the case of the low-rigidity recording material, a leading end of the recording material is still adhered to the transfer belt at a separation portion where the separation roller is provided, so that improper separation occurs.

Therefore, there is a constitution in which waviness is provided on the transfer belt at the separation portion to enhance resilience of the recording material (Japanese Laid-Open Patent Application (JP-A) Hei 8-113408. However, when such a constitution is used in order to provide the waviness on the transfer belt, a large tension is always exerted locally from the separation roller on the transfer belt. As a result, a transfer property is not stabilized by the influence of a resistance non-uniformity due to local abrasion of the transfer belt.

Therefore, a method in which a sheet-like transfer drum is deformed but a degree of abrasion due to the deformation is reduced has been described in JP-A Hei 5-119636. In JP-A Hei 5-119636, a roller movable to a position in which a sheet surface of the transfer is raised from an inside thereof and a position in which the transfer drum sheet surface is not raised is provided. Further, a constitution in which the sheet surface is not raised in a period in which the recording material is not separated, but is raised when the recording material is separated from the sheet surface is described.

In an apparatus in which the recording material is nip-conveyed by the transfer belt and is separated by curvature from the transfer belt by using the separation roller, when the resilience of the recording material is weak (when the rigidity of the recording material is low), separation becomes unstable. As a mean for solving this problem, it was found that the constitution in which a movable push-up means for performing an operation for locally pushing up the transfer belt in order to assist the separation is provided upstream of the separation roller is useful. In the case where the recording material is thin, when the transfer belt is locally raised, the recording material is electrostatically attracted to the transfer belt and therefore is deformed correspondingly to local deformation of the transfer belt, so that even in the case of the thin recording material, the resilience of the recording material can be enhanced. By using this constitution, even in the case where the recording material is thin, the separation of the recording material by curvature from the transfer belt by using the separation roller is facilitated.

On the other hand, the reason why the recording material is electrostatically attracted to the transfer belt as described above is as follows. That is, when the toner (toner image) is transferred from an image bearing member on the recording material carried on the transfer belt, there is a tendency that the transfer belt is charged to an opposite polarity to a normal polarity of the toner and the recording material for carrying the toner is charged to an identical polarity to the normal polarity of the toner. That is, the recording material passing through a transfer portion where the toner is transferred onto the recording material is charged to a polarity in which the recording material is electrostatically attracted to the transfer belt.

However, a transfer current value fluctuates depending on various factors such as a temperature, a humidity, and a material of the recording material. In the case where the transfer current is small, respective charge amounts become small, so that an attraction force between the recording material and the transfer belt is weaken. When the recording material having the weak attraction force to the transfer belt reaches a push-up means, the recording material is liable to be separated from the transfer belt at a recessed portion of the transfer belt generated by the deformation of the transfer belt. As a result, deformation of the recording material becomes insufficient and thus the resilience of the recording material becomes weak, so that a problem that a separating property by the separation roller is lowered occurs.

SUMMARY OF THE INVENTION

A principal object of the present invention is to enhance an electrostatic attraction property between a recording material and a transfer belt at a push-up deformation portion to suppress a lowering in separation property even when a transfer current is small in a constitution in which the recording material is deformed by locally pushing up the transfer belt by a push-up means.

A specific object of the present invention is to provide an image forming apparatus capable of suppressing the lowering in separation property even when the transfer current is small by enhancing the electrostatic attraction property between the recording material and the transfer belt at the push-up deformation portion.

According to an aspect of the present invention, there is provided an image forming apparatus comprising:

an image bearing member;

a stretched rotatable belt member;

transfer means for forming a transfer portion for permitting transfer of a toner image from the image bearing member onto a recording material carried on the belt member;

a separation roller, capable of separating from the belt member the recording material carried on the belt member, for stretching the belt member;

push-up means capable of locally pushing up a belt surface, with respect to a widthwise direction of the belt member, located upstream of the separation roller and downstream of the transfer portion with respect to a rotational direction of the belt member to separate from the belt member the recording material carried on the belt member;

pre-separation charging means, located downstream of the transfer portion and upstream of the push-up means with respect to the rotational direction of the belt member, for electrically charging the recording material by being supplied with a voltage of an identical polarity to a normal charge polarity of a toner; and an execution portion for executing an operation in a mode in which the recording material charged by the supply of the voltage to the pre-separation charging means is separated from the belt member by pushing up the belt member by the push-up means.

These and other objects, features and advantages of the present invention will become more apparent upon a consideration of the following description of the preferred embodiments of the present invention taken in conjunction with the accompanying drawings.

Figure 2:
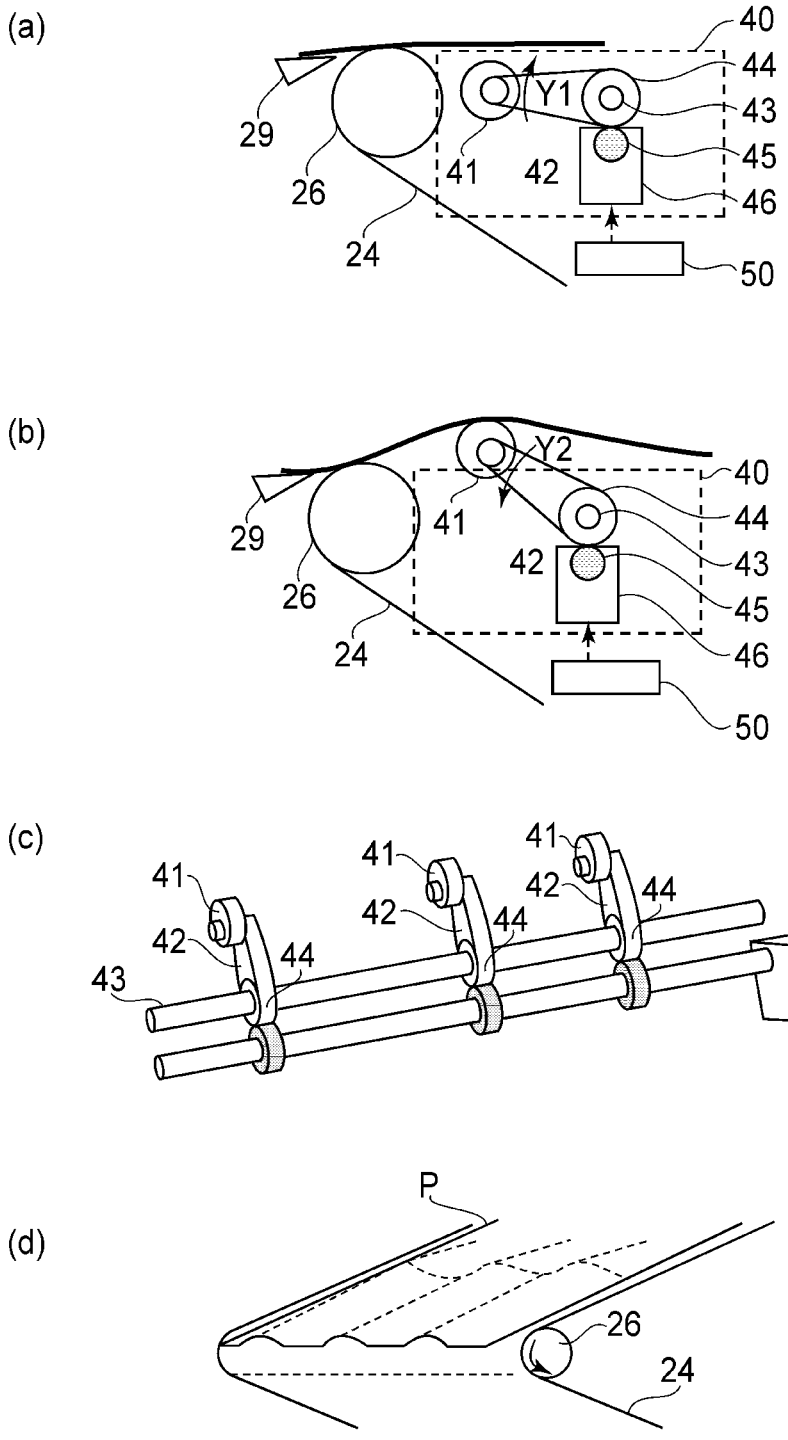

Parts (a) and (b) of FIG. 2 are relation views between a separation device and a transfer belt, and (c) and (d) of FIG. 2 are perspective views of the separation device.

Figure 3:
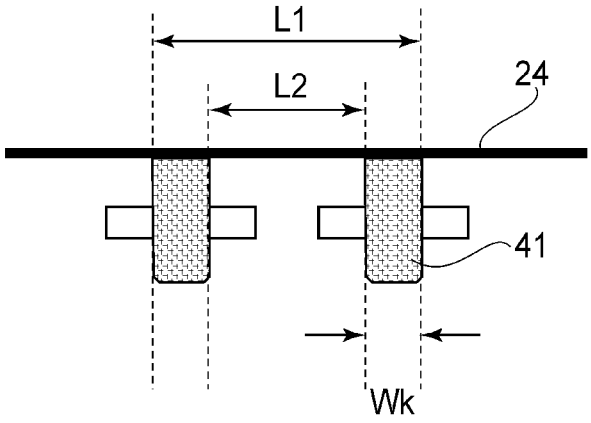

FIG. 3 is a schematic views for illustrating a separation roller.

Figure 4:
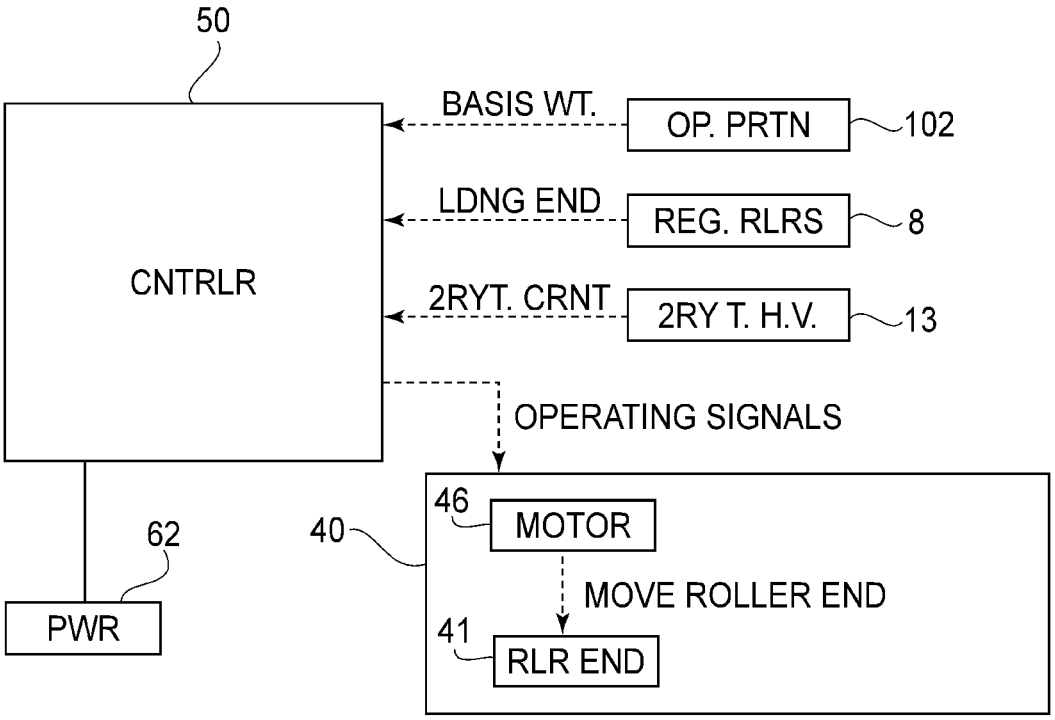

FIG. 4 is a block diagram of the image forming apparatus in Embodiment 1.

Figure 5A:
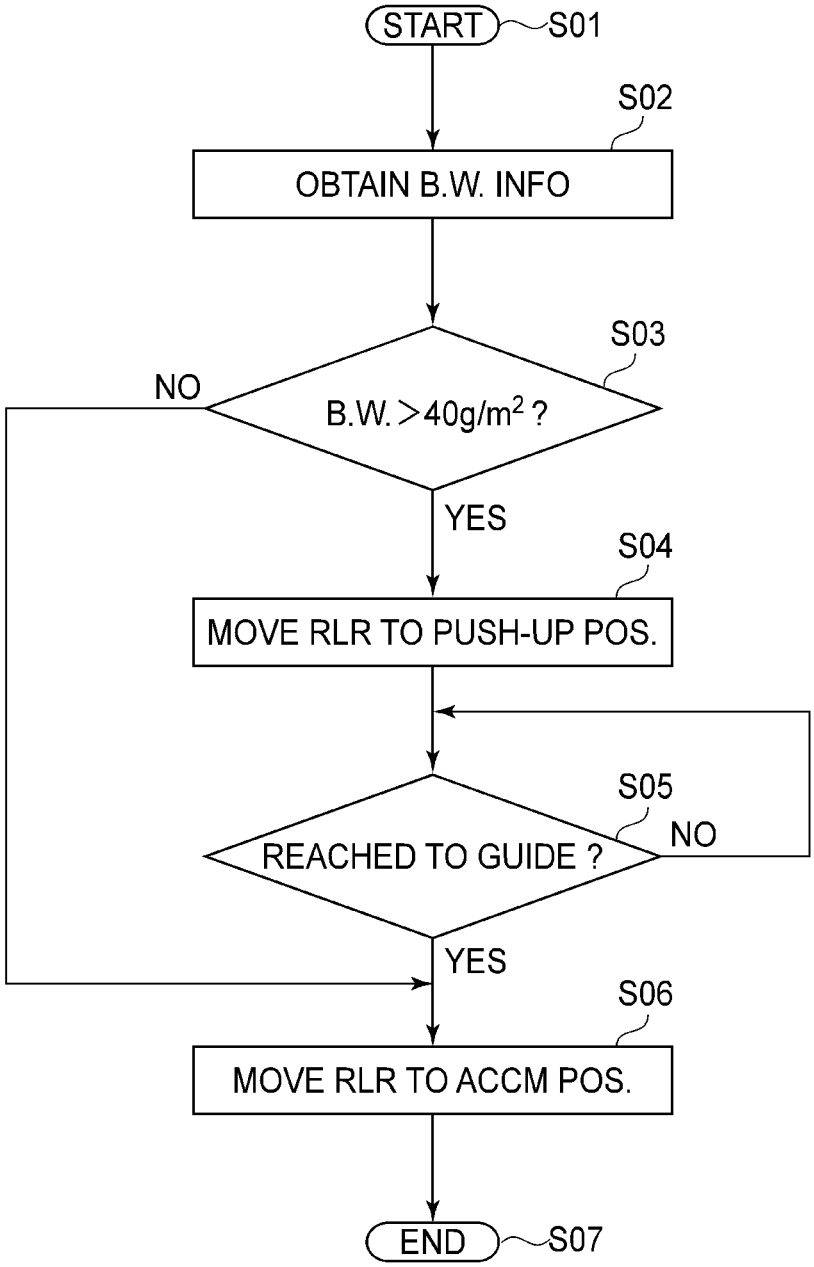
Figure 5B:
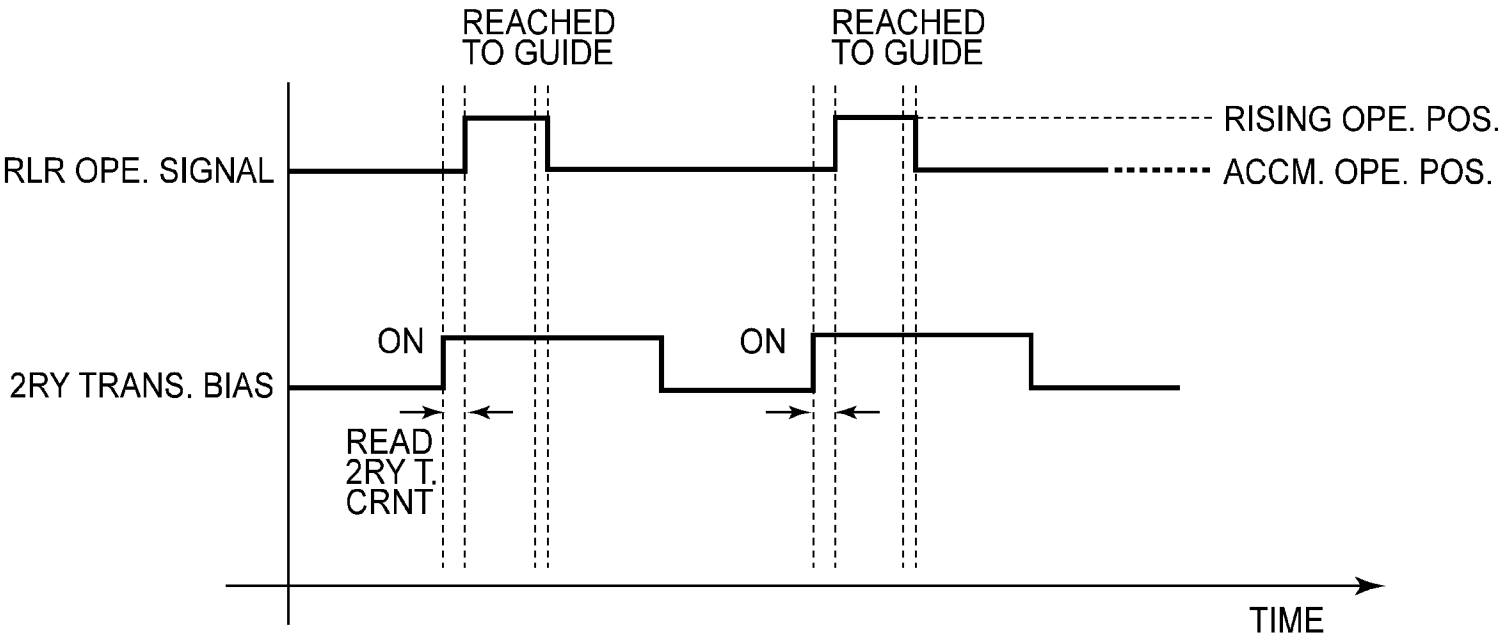

Part (a) of FIG. 5 is a flowchart in Embodiment 1, and (b) of FIG. 5 is a timing chart in Embodiment 1.

Figure 6:
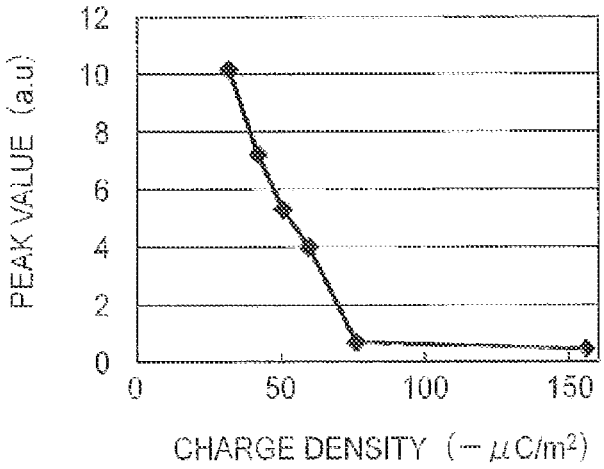

FIG. 6 is a graph showing a relationship between a surface charge density and an electric discharge peak value.

Figure 7:
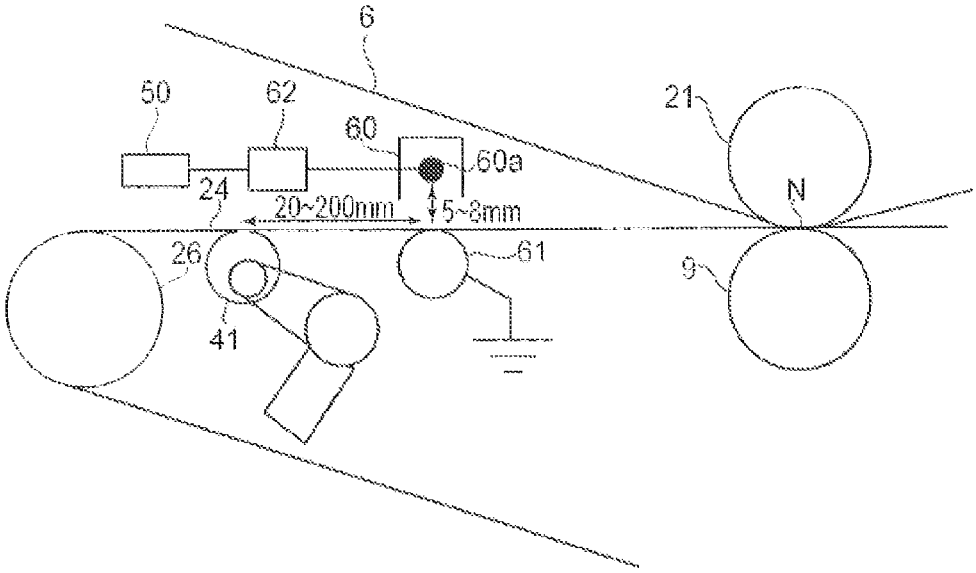

FIG. 7 is a schematic view showing the neighborhood of a pre-separation charger.

Figure 8:
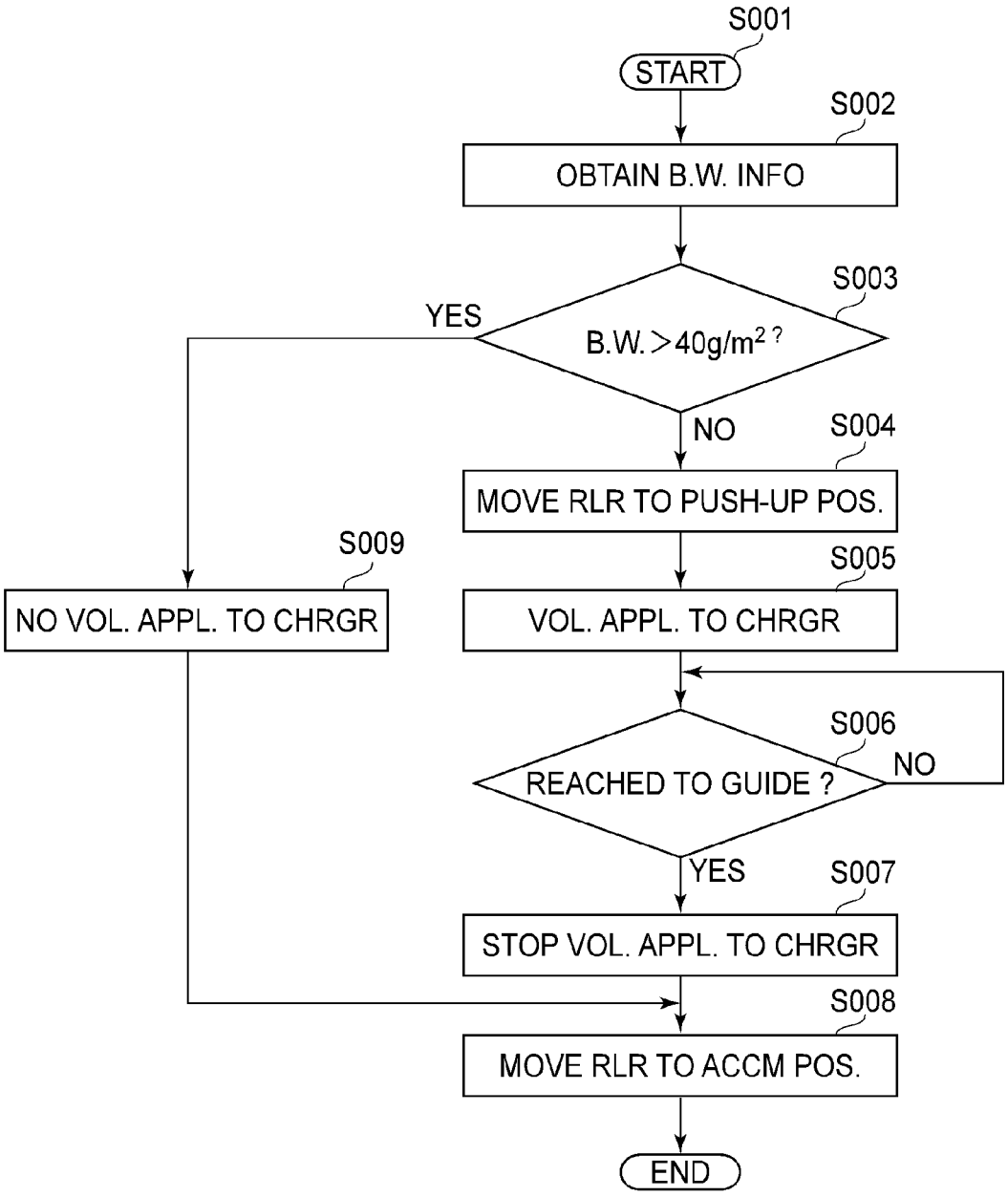

FIG. 8 is an operation flowchart of the pre-separation charger in Embodiment 1.

Figure 9:
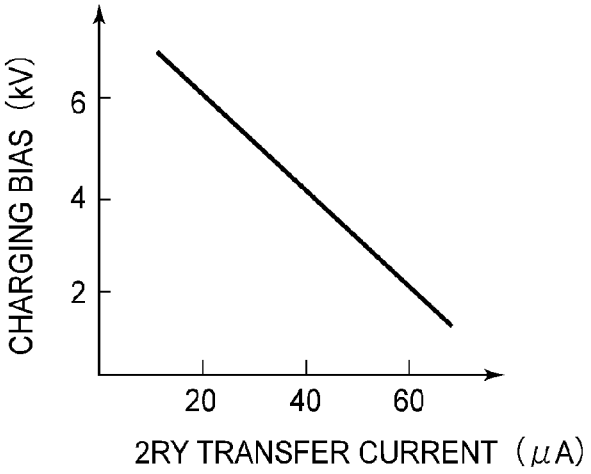

FIG. 9 is a graph showing a relationship between a secondary transfer current absolute value and a bias (voltage) absolute value of the pre-separation charger.

Figure 10:
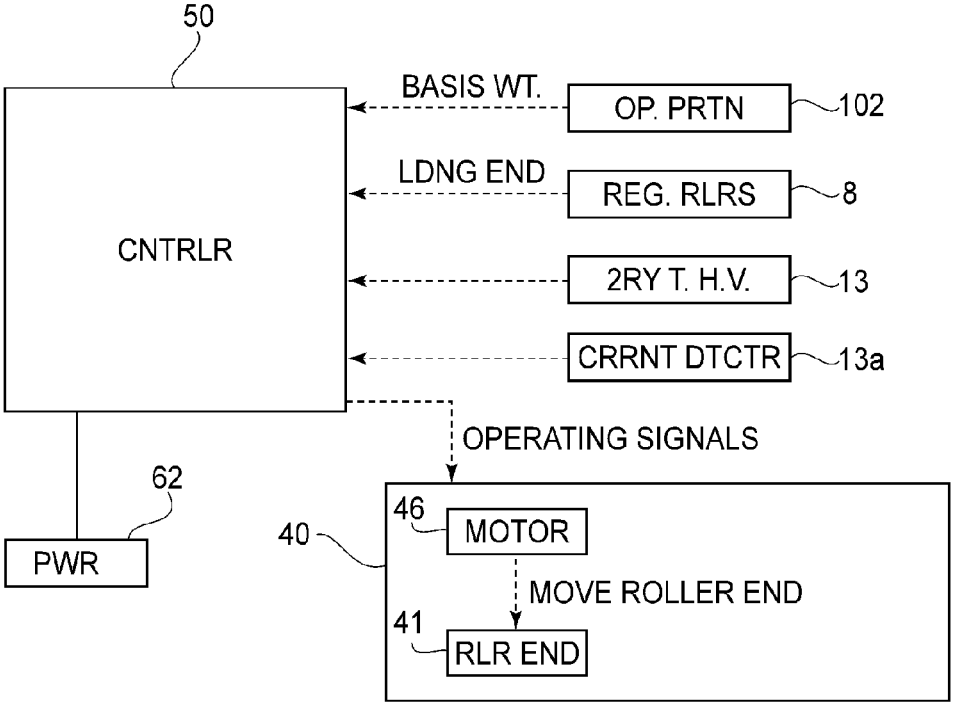

FIG. 10 is a control block diagram in Embodiment 2.

Figure 11:
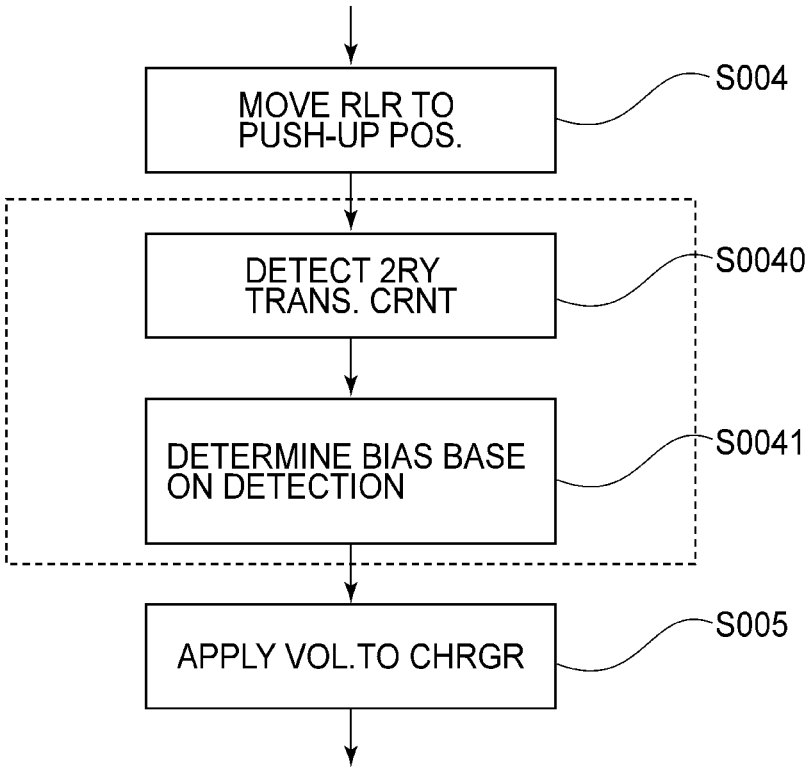

FIG. 11 is an operation flowchart of a pre-separation charger in Embodiment 2.

Figure 12:
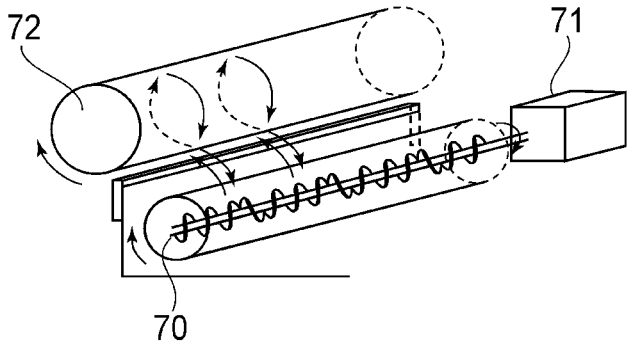

FIG. 12 is a perspective view showing a structure of a developing device in Embodiment 3.

Figure 13:
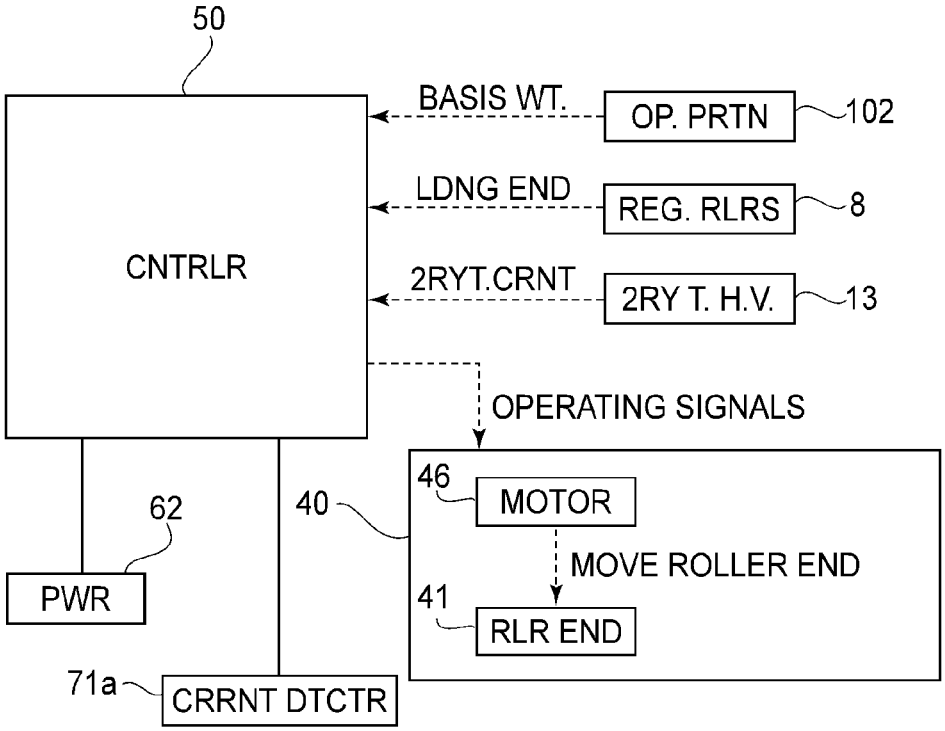

FIG. 13 is a control block diagram in Embodiment 3.

DESCRIPTION OF THE PREFERRED EMBODIMENTS

<Embodiment 1>

(Image Forming Apparatus)

The image forming apparatus according to the present invention will be described.

Figure 1:
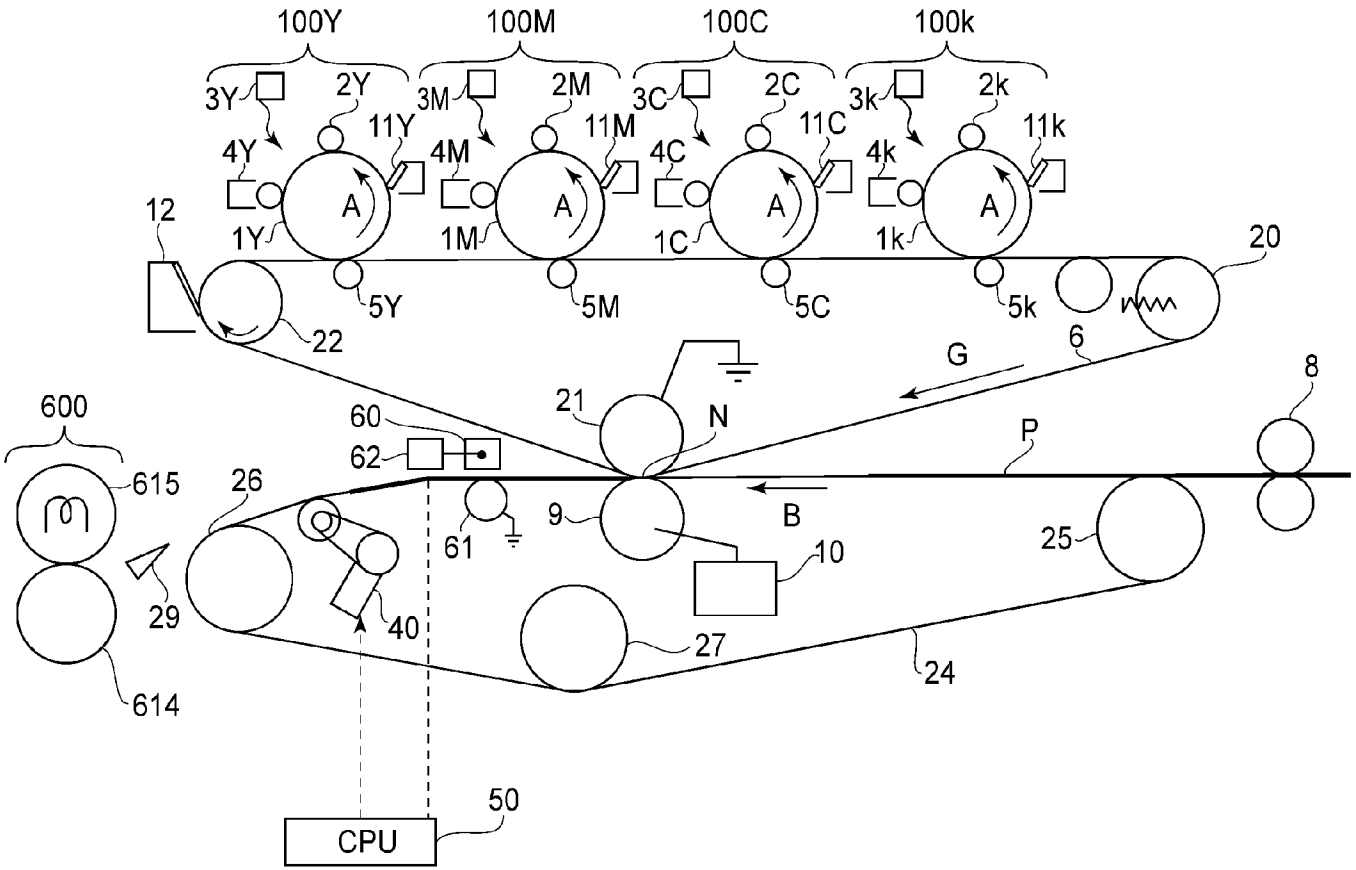
FIG. 1 is a schematic view of an image forming apparatus.

First, a constitution and operation of the image forming apparatus will be described with reference to FIG. 1. The image forming apparatus shown in FIG. 1 is a color image forming apparatus using an electrophotographic process. FIG. 1 is a sectional view of the image forming apparatus of a so-called intermediary transfer tandem type in which four color image forming portions are juxtaposed on an intermediary transfer belt.

First, an image forming portion (image forming unit) 100 will be described. In this embodiment, well-known image forming units 100Y, 100M, 100C and 100*k* are provided. Next, each of the image forming portions will be described.

Photosensitive drums 1Y, 1M, 1C and 1K as an image bearing member are rotationally driven in an arrow A direction.

Charging devices 2Y, 2M, 2C and 2*k* are used for charging the respective photosensitive drums. Exposure devices 3Y, 3M, 3C and 3*k* subject the photosensitive drums to image exposure to form an electrostatic latent image on the basis of inputted image information. Developing devices 4Y, 4M 4C and 4*k* form toner images on the respective photosensitive drums. The developing devices 4Y, 4M, 4C and 4k develop the electrostatic latent images with toners of yellow (Y), cyan (C), magenta (M) and black (k), respectively. Cleaning devices 11Y, 11M, 11C and 11*k* are used for removing the toners remaining on the photosensitive drums after a transfer step.

Next, an intermediary transfer belt 6, which is an intermediary transfer member or the image bearing member, opposing the respective photosensitive drums will be described. The intermediary transfer belt 6 is stretched by a plurality of stretching rollers 20, 21 and 22 as a stretching member, and is configured to be rotationally driven in an arrow G direction. In this embodiment, the stretching roller 20 is a tension roller for providing tension to the intermediary transfer belt 6 so that the tension of the intermediary transfer belt 6 is constant. The stretching roller 22 is a driving roller for transmitting a driving force to the intermediary transfer belt 6, and the stretching roller 21 is an inner opposite roller for forming a secondary transfer nip N. Inside the intermediary transfer belt 6, primary transfer rollers 5Y, 5M, 5C and 5*k* which are primary transfer members for transferring onto the intermediary transfer belt 6 the toner images formed on the respective photosensitive drums. By the constitution described above, the four color toner images are electrostatically transferred superposedly onto the intermediary transfer belt 6 and are conveyed to the secondary transfer portion N.

Next, a constitution of the secondary transfer portion N where the toner images formed (transferred) on the intermediary transfer belt 6 are transferred onto paper as the recording material will be described. The secondary transfer portion N is formed by the inner opposite roller 21 which is a first transfer member provided at an inner surface of the intermediary transfer belt 6 and an outer opposite roller 9 which is a second transfer member for urging the inner opposite roller 21 from an outer surface side of the intermediary transfer belt 6 bias the intermediary transfer belt 6 and a transfer belt 24. Further, by applying a transfer bias voltage of an opposite polarity to a normal charge polarity of the toner from a secondary transfer high voltage source 10 to the outer opposite roller 9, the toner (image) is transferred onto the recording material. Incidentally, the normal charge polarity of the toner refers to the charge polarity of the toner capable of developing the electrostatic latent image formed on each photosensitive member (drum). Therefore, in the case where the photosensitive member is charged to the negative polarity and is exposed to light and the resultant electrostatic latent image is reversely developed, the normal charge polarity of the toner is the negative polarity.

The toner images formed on the intermediary transfer belt 6 are sent from a registration roller 8 to the transfer belt 24 with preset timing and are secondary transferred onto the recording material P which has been conveyed to the secondary transfer portion N. Thereafter, the recording material P is conveyed to a recording material guide 29 and then is conveyed to a fixing device 600. The fixing device 600 fixes the toner images on the recording material by predetermined pressure and heat in a fixing nip formed between a fixing roller 615 and a pressing roller 614 which are opposed to each other as shown in FIG. 1.

<Transfer Belt>

The transfer belt 24 is a belt member for nip-conveying the recording material. The transfer belt 24 is stretched by a plurality of stretching rollers 25, 26 and 27 which are a stretching member and is rotationally moved in an arrow B direction. In this embodiment, the stretching roller 26 is a separation roller for forming a separation portion, where the recording material is separated by curvature, by arcuately changing a movement direction of the transfer belt 24. Further, in this embodiment, this roller 26 also functions as a driving roller for transmitting the driving force to the transfer belt 24. Further, the stretching rollers 25 and 27 are rotated by the rotation of the transfer belt 24. Each of the stretching rollers 25, 26 and 27 is a cylindrical roller.

The recording material P conveyed from the registration roller 8 by being timed to the toner images on the belt 6 so as to be superposed on the toner images starts contact with the transfer belt 24 on a belt surface of the transfer belt 24 located upstream of the secondary transfer portion N with respect to the movement direction of the transfer belt 24. In this embodiment, a constitution in which an attracting means such as an attracting roller for electrostatically attracting the recording material P to the transfer belt 24 is not provided is employed but the recording material P may also be attracted to the transfer belt 24 by using the attracting means.

In the rotational direction of the transfer belt 24, the recording material P placed on the surface of the transfer belt 24 at the upstream side of the secondary transfer portion N with respect to the rotational direction of the transfer belt 24 is conveyed to the secondary transfer portion together with the movement of the transfer belt 24. After the toner images are transferred onto the recording material P at the secondary transfer portion N, the recording material P is separated from the transfer belt 24. In this embodiment, in the case where a basis weight of the recording material P is larger than a predetermined value, an auxiliary separation device 40 described later is not operated but the recording material P is separated by curvature of the state 25 from the transfer belt 24 at the separation portion. On the other hand, in the case where the basis weight of the recording material P is the predetermined value or less, by the operation of the auxiliary separation device 40 described later, the resilience of the recording material P is reinforced, so that the recording material P is separated by curvature from the transfer belt 24 at the separation portion.

At a downstream side of the separation portion with respect to the recording material conveyance direction, a recording material guide member 29 is provided with a small gap between itself and the belt 24. The recording material P separated from the transfer belt 24 at the separation portion is caught by the recording material guide member 29 at its leading end portion and then moves toward the fixing device 600 side while sliding on the guide member 29.

Further, in this embodiment, as described later, a pre-separation charger 60 as a pre-separation charging means and a grounded opposite roller 61 are provided. In this embodiment, the toner on the recording material is in an unfixed state and therefore a corona charger which is in non-contact with the recording material is used as the pre-separation charger 60 so as not to slide on the unfixed toner image. Further, a power source 62 for applying a voltage, of the identical polarity to the normal charge polarity of the toner, to a wire of the corona charger is provided. An operation of the pre-separation charger 60 will be described later.

In this embodiment, with respect to the transfer belt 24, carbon black as an antistatic agent is incorporated in an appropriate amount into resin such as polyimide or polycarbonate or various rubbers or the like. The transfer belt 24 has a volume resistivity of $1\times10^{9}$ to $1\times10^{14}$ ($\Omega\cdot$cm) and a thickness of 0.07 to 0.1 (mm) is used. Further, as the transfer belt 24, an elastic member having a value of Young's modulus of 0.5 MPa or more and 10 MPa or less as measured according to the tensile testing method (JIS K 6301) is used. Further, by using, as the transfer belt 24, the elastic member having the Young's modulus of 0.5 MPa or more as measured by the tensile testing, rotational drive of the transfer belt 24 can be effected while sufficiently keeping a shape of the belt. On the other hand, by using the member, having the Young's modulus of about 10 MPa or less, which can be sufficiently deformed elastically, it becomes possible to locally deform the transfer belt 24 by an auxiliary separation device 40 described later, thus separating the recording material P from the transfer belt 24. Further, by permitting elastic deformation, a relaxation phenomenon of the transfer belt 24 when the auxiliary separation device 40 is retracted, and therefore it becomes possible to prevent a lowering in lifetime of the transfer belt 24 by the auxiliary separation device 40.

(Auxiliary Separation Device 40)

In this embodiment, in order to permit the separation of the recording material from the transfer belt, with respect to a widthwise direction of the transfer belt, the auxiliary separation device 40 as a push-up means for locally pushing up the transfer belt to deform the transfer belt is provided. The auxiliary separation device 40 is provided so as to act on the inner surface side which is downstream of the secondary transfer portion N and upstream of the stretching roller 26 with respect to the recording material conveyance direction.

Detailed constitution and operation of the separation assisting device 40 are shown in (a), (b), (c) and (d) of FIG. 2. The auxiliary separation device 40 includes an auxiliary separation roller FIG. 2 and (b) of FIG. 2. The auxiliary separation device 40 includes an auxiliary separation roller 41 which is an auxiliary separation member and a roller frame 42 for rotatably supporting the auxiliary separation roller 41. Further, the auxiliary separation device 40 includes a roller swing center shaft 43 which is a swing movement center of the auxiliary separation roller 41, a roller swinging gear 44 for swinging and moving the auxiliary separation roller 41 about the shaft 43, a motor drive transmission gear 45 for transmitting a driving force of the roller swinging gear 44, and a motor 46 which is a driving source. The driving force from the motor 46 is transmitted to the roller swinging gear 44 by the motor drive transmission gear 45. Here, between the roller swinging gear 44 and the roller swing center shaft 43, a bearing is provided and therefore the roller swing center shaft 43 is not influenced by the rotation drive of the motor 46 and thus the position thereof is not moved.

Part (c) of FIG. 2 is a perspective view of the auxiliary separation device 40, in which a plurality of auxiliary separation rollers 41 are juxtaposed with respect to the widthwise direction of the transfer belt 24. Here, the widthwise direction refers to a direction perpendicular to the movement direction of the moving belt surface.

The auxiliary separation roller 41 and the roller frame 42 is swung about the roller swing center shaft 43 from a roller accommodating position in which the roller 41 is spaced from the transfer belt 24, in Y1 direction by forward rotation of the motor 46 in a predetermined amount (a) of FIG. 2), and the roller 41 is contacted to the inner surface of the transfer belt 24, so that the belt 24 can be moved to an operation position in which the belt 24 is pushed up ((b) of FIG. 2). Further, by reverse rotation of the motor 46 in a predetermined amount, the roller 41 is swung from the position of (b) of FIG. 2 in Y2 direction and thus can be moved to the roller accommodating position which is a retracted position shown in (a) of FIG. 2.

Here, in a state (spaced state) of (a) of FIG. 2, a distance from the auxiliary separation roller 41 to the transfer belt 24 is 4-8 mm. In this embodiment, such a distance is set as a gap in which the contact between the auxiliary separation roller 41 and the transfer belt 24 can be prevented with reliability in the spaced state but the distance in the present invention is not limited to the above value. In either case, in the state of (a) of FIG. 2, even with respect to the recording material conveyance direction and also the belt widthwise direction, in a section from the roller 61 to the roller 26, the surface of the belt 24 is flat and has a planar shape.

In the state (pushed-up state) of (b) of FIG. 2, an amount of movement of the auxiliary separation roller 41 from the state of (a) of FIG. 2 is set so that the auxiliary separation roller 41 pushes up the belt surface of the transfer belt 24 by 3-6 mm from the inner surface side. In this embodiment, such a distance is set as an interval in which pushing-up of the belt surface of the transfer belt 24 can be ensured in the pushed-up state but is not limited in the present invention to the above value. As a constitution for ensuring the amount of movement of the roller 41 so as to be a set value, it is possible to employ a constitution in which a stopper member for regulating the movement amount of the roller 41 is provided or a constitution in which an amount of rotation of the roller frame 42 is controlled. Incidentally, the pushing-up amount is based on the belt surface in the spaced state of (a) of FIG. 2.

In either case, in the state of (a) of FIG. 2, a plurality of (three in (c) of FIG. 2) auxiliary separation rollers 41 locally push up and elastically deform the transfer belt 24 (at three positions in the figure) with respect to the widthwise direction. For that reason, a stepped portion is generated between a portion contacted to and pushed up by the auxiliary separation roller 41 and a portion which is not contacted to the roller 41. As a result, the transfer belt surface is waved in the widthwise direction, so that a plurality of (three in (d) of FIG. 2) mountain-like stripes with respect to the recording material conveyance direction.

When the recording material having a present thickness or less is conveyed, by the pushing up by the auxiliary separation roller 41, the local deformation of the transfer belt 24 is caused with respect to the widthwise direction as described above. Incidentally, the electric charge of the opposite polarity to the toner charge polarity is provided to the inner surface of the transfer belt 24 by the transfer roller 9 and therefore the recording material is in a state in which the recording material is electrostatically attracted to the transfer belt 24 at least by the influence of electrostatic transfer at the secondary transfer portion N. Further, the low-rigidity recording material is weak in resilience and is liable to be deformed. For that reason, when an electrostatic attraction force of the recording material is sufficient, as shown in (d) of FIG. 2, with the deformation of the transfer belt 24, waviness in a shape corresponding to the deformed shape of the transfer belt 24 also occurs on the low-rigidity recording material. As a result, geometrical moment of inertia of the recording material, i.e., the strength of resilience of the recording material becomes large. This attributes to the curvature separation of the thin recording material with weak resilience at the separation portion.

Incidentally, only one roller 41 may be provided in an area in which the recording material passes but the strength of resilience of the thin recording material is more liable to be increased. Therefore, it is preferable that the plurality of the rollers 41 are provided in the area in which the recording material passes. As is also understood by making reference to (c) of FIG. 2, in this embodiment, the constitution in which the plurality of the auxiliary separation rollers 41 are provided with intervals with respect to the widthwise direction is employed. The auxiliary separation rollers 41 in this embodiment are disposed in the following manner. The auxiliary separation roller 41 at a central portion is disposed so as to contact the back surface of the belt 24 at a position corresponding to the substantially central portion of the recording material with each of sizes to be conveyed in the apparatus in which the recording material of any width size has a widthwise center which is substantially coincide with a common reference line. Further, longitudinal end portion auxiliary separation rollers 41 are disposed so as to contact the back surface of the belt 24 at positions each within a widthwise passing area of a preset passable recording material of a maximum size and each corresponding to an end portion area. Here, the preset passable recording material of the maximum size refers to a recording material of a maximum width size which can be used for image formation in the image forming apparatus described in a specification manual or the like of the apparatus.

Here, in the case where the plurality of the auxiliary separation rollers 41 are disposed, when an arrangement interval of the auxiliary separation rollers 41 is excessively narrow, the transfer belt 24 is raised as a whole. As a result, the waviness with a preferred of stepped amount cannot be formed on the transfer belt 24 and thus a separation property cannot be enhanced. In order to form the plurality of local projections which caused the waviness with the preferred stepped amount, there is a need to provide a wide arrangement interval, between adjacent rollers 41, to some extent.

Therefore, in this embodiment, a width of each auxiliary separation roller 41 and the interval of the auxiliary separation rollers 41 are set from such a viewpoint. FIG. 3 is a schematic view for illustrating the width of the auxiliary separation roller 41 and the preferred interval between the auxiliary separation rollers 41. L1 represents a length between outer sides of adjacent auxiliary separation rollers 41 and Wk represents the width of each auxiliary separation roller 41 contacting the belt 24. L2 represents a length between opposing (inner) sides of the adjacent auxiliary separation rollers 41 and is obtained by L1—2 Wk. In this embodiment, L2 is set at a value which is 2 Wk or more. That is, a length in which the auxiliary separation rollers 41 are not contacted to the transfer belt 24 is longer than a length in which the auxiliary separation assisting rollers 41 are contacted to the transfer belt 24m thus being raised at a whole. As a result, the transfer belt 24 is locally deformed, so that unevenness is liable to be provided on the transfer belt 24.

In this embodiment, the three auxiliary separation rollers 41 are provided with respect to the widthwise direction and the interval between the central auxiliary separation roller 41 and the adjacent auxiliary separation roller 41 is 110 mm. The recording material P is conveyed so that the widthwise center of the recording material P coincides with the widthwise center of the central auxiliary separation roller 41.

By disposing the auxiliary separation rollers 41 as described above, the plurality of projections capable of meeting the thin paper with a size, as the widthwise size of the recording material which is recommended to be conveyed, ranging from a minimum size for a postcard to a maximum size for the recording material of 330 mm in width are formed on the transfer belt 24. For example, in the case where the widthwise size of the recording material to be conveyed is the postcard size of 100 mm as the minimum size, at the projection portion formed on the transfer belt 24 by the pushing up by the central (single) auxiliary separation roller 41, the mountain-like waviness is formed on the recording material. By this waviness shape, the strength of resilience of the recording material is increased, so that the recording material can be separated from the transfer belt 24.

Further, when the recording material of 330 mm in width which is the maximum size as the widthwise recording material size is conveyed, three projections are formed by the three auxiliary separation rollers 41, so that valley-like waviness is formed on the recording material between the adjacent projections. In the case where the recording material size is large, even when the same waviness as that in the case of the small-sized recording material is caused, the weight of the recording material itself is also increased and thus is largely influenced by gravitation, so that the strength of resilience of the recording material is lowered. For that reason, in the case where the recording material size becomes large, the plurality of auxiliary separation rollers 41 may desirably be used. Incidentally, in this embodiment, with respect to the recording material widthwise length of 330 mm, the length between the locally end portion auxiliary separation rollers 41 is 220 mm and thus being shorter than the recording material widthwise length. By making the length between the locally end portion auxiliary separation rollers 41 shorter than the recording material widthwise length, the waviness can be formed on the recording material with reliability by the projections formed by the auxiliary separation rollers 41, so that there is a need to satisfy such a length relationship.

Incidentally, the auxiliary separation roller 4 is formed of an ethylenepropylene rubber (EPDM) and 6-10 mm in outer diameter and about 5-15 mm in length or width. When such auxiliary separation rollers 41 push up the transfer belt 24, the local projections are formed on the transfer belt 24 with respect to the widthwise direction of the transfer belt 24. The auxiliary separation rollers 41 may desirably be formed by using a rubber, which is an elastic member, in order to alleviate the abrasion of the inner surface of the transfer belt 24.

Incidentally, in this embodiment, in the spaced state of (a) of FIG. 2, the auxiliary separation rollers 41 are separated from the transfer belt 24 but a constitution in which the auxiliary separation rollers 41 are contacted to the transfer belt 24 to the extent that the auxiliary separation rollers 41 do not influence on the shape of the transfer belt surface may also be employed. Here, the extent that the auxiliary separation rollers 41 do not influence on the shape of the transfer belt surface refers to such an extent that substantial unevenness on the transfer belt 24 by the auxiliary separation rollers 41 does not appear. Specifically, the extent may preferably fall within a range in which a maximum stepped amount (a difference in height of the belt surface between a maximum position and a minimum position) is 0.5 mm.

An operation position of the auxiliary separation device 40 is controlled by a controller (control portion) 50. A relationship of this control is shown in FIG. 4. Control of an operation position signal of the auxiliary separation device 40 is based on basis weight information of the recording material P designated by a user, recording material position information obtained from recording material feeding timing by the registration roller pair 8 and a secondary transfer current value read by a secondary transfer high-voltage source 13. Here, a block diagram of FIG. 4 will be described. In this embodiment, the controller 50 includes CPU, ROM and RAM. The information from an operating portion 102 at which the user operates the image forming portion is inputted into the controller 50. Operation timing of the registration roller pair 8 is inputted into the controller 50. Information of the secondary transfer current value from the secondary transfer high-voltage source is inputted into the controller 50. The controller 50 controls the operation (sending of raising and accommodating operations of the auxiliary separation rollers) of a motor 46 for the driving auxiliary separation device 40 so that the end of the auxiliary separation rollers 41 are moved to the raising and accommodating portion.

Next, the operation position control of the auxiliary separation device 40 is effected along a flowchart shown in (a) of FIG. 5. Here, the operation position control of the auxiliary separation device 40 is effected depending on the basis weight of the recording material.

In this embodiment, the following two patterns (modes) have been stored in the ROM in advance.

In the case where the recording material has the basis weight of 40 g/m$^2$ or less, the auxiliary separation rollers 41 locally deform the transfer belt 24. In the case where the recording material has the basis weight of more than 40 g/cm$^2$, the auxiliary separation rollers 41 are separated (spaced). Further, the controller 50 performs the function of an execution portion for executing the operation in each of the modes.

Further, the basis weight of the recording material will be described. The basis weight is the weight of the recording material per 1 m$^2$ (per unit area). Incidentally, in this embodiment, the basis weight of 40 g/m$^2$ is an example and the basis weight may also be another value. With respect to the basis weight, there are the case where the user inputs the basis weight at the operating portion 102 and the case where the user inputs into the image forming apparatus the basis weight of the recording material is accommodated in a recording material accommodating portion. On the basis of the information on the basis weight inputted into the image forming apparatus in these cases, the controller 50 determines the operation of the auxiliary separation assisting device 40. Incidentally, in this embodiment, as the rigidity of the recording material, the basis weight is used but the rigidity of the recording material may also be associated with the thickness of the recording material. When the basis weight becomes large, the rigidity of the recording material becomes high, and when the basis weight becomes small, the rigidity of the recording material becomes low. In the case where the rigidity of the recording material is associated with the thickness of the recording material, when the thickness of the recording material becomes large, the rigidity of the recording material becomes high. On the other hand, when the thickness of the recording material becomes small, the rigidity of the recording material becomes low. Thus, in the case of using the thickness of the recording material, a constitution in which a detecting member, which has been conventionally known, for detecting the thickness of the recording material is provided upstream of the registration roller with respect to the recording material conveyance direction and on the basis of its output, the controller 50 controls the operation of the auxiliary separation device 40 may also be employed. In that case, when the recording material thickness is 50 μm or less, the auxiliary separation rollers 41 locally deform the transfer belt 24. Further, when the recording material thickness is more than 50 μm, the auxiliary separation rollers 41 are spaced from the transfer belt 24.

A flowchart of operation control of the auxiliary separation device 40 will be described with reference to Figure (a) of FIG. 5.

First, as shown in (a) of FIG. 5, the control is started by input of an image forming signal (S01). The controllers 50 reads the information on the basis weight of the recording material used for the image formation, i.e., the basis weight information of the recording material se by the user at a user operating portion 102 in this embodiment (S02). The basis weight is judged by the controller as to whether or not it is larger than 40 g/m$^2$ (S03). In the case where the basis weight of the recording material is 40 g/m$^2$ or less, in order to separate the recording material from the transfer belt 24, the operation for forming the projections by pushing up the transfer belt 24 by the auxiliary separation rollers 41. The auxiliary separation rollers 41 are moved in the Y1 direction and is disposed at the push-up position in which the transfer belt 24 is pushed up (S04). On the transfer belt 24 which has been deformed by the auxiliary separation rollers 41, the recording material P is increased in strength of resilience provision of by waviness and thus is separated from the transfer belt 24 before the recording material P reaches the stretching roller 26. In the case where the controller 50 judges in S04 that the basis weight the recording material is larger than 40 g/m$^2$, the controller 50 disposes the auxiliary separation rollers 41 at the accommodating position (S06). Next, the controller 50 judges whether or not the leading end of the recording material P has reached the recording material guide 29 (S05). In this embodiment, a constitution in which an unshown recording material detecting sensor is provided to the recording material guide 29 is employed, and judgment as to whether or not the leading end of the recording material reaches the recording material guide 29 is made by this recording material detecting sensor. Without providing the recording material detecting sensor to the recording material guide 29, another method such that a time is counted from a predetermined point to detect the position of the recording material may also be employed. In the case where the recording material reaches the recording material guide 29, the controller 50 judges that the separation is performed and moves the auxiliary separation rollers to the accommodating position (S06), and thus the control is ended (S07).

On the other hand, in the case where the recording material detecting sensor does not detect the recording material, the controller 50 judges that the recording material has not yet reached the recording material guide 29 and pushes up the auxiliary separation rollers (S04), so that the separation using the auxiliary separation rollers 41 is performed.

In this embodiment, in a particular case, the constitution in which the auxiliary separation rollers 41 are pushed up was employed. This embodiment is an example and therefore there is no problem even when another value of the basis weight is used.

By using such a constitution, with respect to the recording materials of many types, the separation from the transfer belt 24 becomes possible.

Timing when the operation position control of the auxiliary separation device 40 is effected will be described with reference to (b) of FIG. 5. After an operation for reading the secondary transfer current amount is performed before the toner image is transferred onto the recording material, movement of the auxiliary separation device 40 from the retracted position to the push-up position is effected together with the execution of the transfer operation of the toner image onto the recording material. Here, as shown in (b) of FIG. 5, at the time when the leading end of the recording material has reached the recording material guide 29, a signal for performing an operation for accommodating the auxiliary separation device 40 from the push-up position of the transfer belt 24 to the retracted position is transmitted from the controller 50 to the auxiliary separation device 40. In this embodiment, when the auxiliary separation device 40 is moved to the retracted position, the secondary transfer operation is performed. Incidentally, the state in which the transfer belt 24 is pushed up is shown in (b) of FIG. 2, and the retracted state is shown in (a) of FIG. 2. The auxiliary separation device 40 is configured to be moved to the retracted position after the end, of the image formation, when the recording material is discharged from the image forming apparatus and therefore the auxiliary separation device 40 is in a state in which the auxiliary separation device 40 is located at the retracted position during a subsequent image forming operation. Incidentally, whether or not the leading end of the recording material P reaches the recording material guide 29 is detected by the recording material detecting sensor provided to the recording material guide 29.

(Pre-Separation Charger)

By the movement of the transfer belt 24 in the arrow B direction, the recording material P passes through the secondary transfer nip N formed by the stretching roller 21 and the secondary transfer roller 9. At this time, the secondary transfer voltage of the opposite polarity to the toner charge polarity is applied to the recording material P via the transfer belt 24 by the secondary transfer roller 9, so that the toner images on the intermediary transfer belt 6 are collectively transferred onto the recording material P. At that time, at upstream and downstream portions of the secondary transfer nip N, electric discharge occurs in a small gap between the recording material P and the intermediary transfer belt 6, so that the recording material P is charged to the same polarity as the charge polarity of the toner. That is, the charged state of the recording material P passing through the secondary transfer portion N is formed by the charging due to the toner transfer and the charging to the same polarity as the toner charge polarity by the electric charge injection due to the electric discharge. The electric charge of the recording material P includes an image charge of the opposite polarity to the toner charge polarity in the neighborhood of the contact surface of the transfer belt 24 with the recording material P and therefore the recording material P and the transfer belt 24 are attracted by Coulomb force. This attracting force depends on the charge amount of the recording material P, i.e., a voltage value of the secondary transfer bias. For that reason, the attracting force of the recording material P to the transfer belt 24 fluctuates depending on the secondary transfer bias. Therefore, in the case where the auxiliary separation device 40 is used, when the attracting force is weak, the recording material P is liable to be raised from the transfer belt 24 and thus the degree of the waviness formed on the recording material P becomes small, so that a problem of a lowering in separation stability occurs.

Therefore, this embodiment is characterized in that the pre-separation charger as a pre-separation means for reducing a degree of the lowering in attracting force between the recording material and the transfer belt is provided. The pre-separation charger charges the recording material to the same polarity as the normal charge polarity of the toner. Incidentally, in this embodiment, the pre-separation charger is the corona charger.

By employing the above constitution, the following effects are achieved.

First, when the amount of the charge of the recording material P of the same polarity as the normal charge polarity of the toner is increased, the attracting force between the recording material P and the transfer belt 24 is strengthened, so that the recording material P is less liable to be separated from the transfer belt 24 during formation of wavy shape by the auxiliary separation rollers 41. As a result, when the paper (recording material) P follows the wavy shape of the transfer belt 24, a desired effect of providing the resilience is achieved, so that the separation property can be enhanced.

Secondly, with a larger amount of the charge of the recording material P of the same polarity as the normal charge polarity of the toner, separation electric discharge when the recording material P is separated from the transfer belt 24 frequently occurs but any electric discharge becomes weak, so that there is an effect such that image defect is not readily caused. FIG. 6 shows a relationship, between an electric discharge peak value of the separation electric discharge and a surface charge density during the separation between the recording material and the transfer belt, prepared in consideration of Paschen's electric discharge law. Referring to this figure, it is understood that the electric discharge peak value becomes smaller with an increasing absolute value of the recording material charge amount (surface charge density).

Next, with reference to FIG. 7, a constitution of the pre-separation charger in this embodiment will be described.

With respect to the movement direction of the transfer belt 24, at a side downstream of the secondary transfer portion N and upstream of the position in which the rollers 41 of the auxiliary separation device 40 contact the belt 24, the corona charger 60 opposing the belt surface on which the recording material is carried is disposed. Further, an electroconductive opposite roller 61 which opposes the charger 60 via the transfer belt 24 is disposed and contacted to the back surface of the transfer belt 24.

A high-voltage source 62 for charging bias application is connected to a wire 60*a* of the corona charger 60, so that a driving signal to the high-voltage source is sent from the controller 50 via a corona charger control circuit (control means). By applying the bias, of the same polarity as the normal charge polarity of the toner, to the corona charger wire 60*a*, the amount of the charge of the recording material P of the same polarity as the toner charge polarity is increased.

The arrangement of the corona charger 60 is shown in FIG. 7. At the movement direction position of the transfer belt 24, a distance from a contact between the auxiliary separation rollers 41 and the transfer belt 24 to a contact between the opposite roller 61 and the transfer belt 24 is about 20-200 mm. A distance between the wire 60*a* of the corona charger 60 and the transfer belt surface is 5-8 mm.

The opposite roller 61 is a straight roller of 5-20 mm in diameter. Incidentally, the opposite roller 61 functions as an opposite electrode of the corona charger 60 and also performs the function of cancelling the waviness of the transfer belt 24 formed by the rollers 41. That is, in order to uniformly providing the electric charge to the recording material P at the entire surface, there is a need that the distance between the wire 60*a* of the corona charger 60 and the transfer belt surface is uniform. Therefore, the opposite roller 60 functions as the stretching roller for stretching the transfer belt 24. That is, the opposite roller 61 smoothly holds the transfer belt surface with respect to the belt widthwise direction in an area in which the transfer belt surface is irradiated with the electric charge from the corona charger 60. As a result, a sufficient electric charge is provided to the recording material P over the widthwise direction, so that an occurrence of an insufficient charge portion is prevented.

In this embodiment, the bias applied to the wire 60*a* is set at two different values for the states including the case where the auxiliary separation rollers 41 are raised and the case where the auxiliary separation rollers 41 are not raised. Incidentally, in this embodiment, in the case where the auxiliary separation rollers 41 are raised, a voltage of −5 kV is applied to the wire 60*a*. This voltage value is determined under a condition in which the thin recording material P is not separated from the transfer belt 24, i.e., a condition in which the separation property is ensured. In the case where the auxiliary separation rollers 41 are not raised, the bias is not applied to the wire 60*a*. Incidentally, in this embodiment, in the case where the auxiliary separation rollers 41 are not raised, the bias application is turned off. However, in the case where the auxiliary separation rollers 41 are not raised, a constitution in which the bias which has an absolute value smaller than an absolute value of the basis applied in the case where the auxiliary separation rollers 41 are raised and which has the same polarity as the normal charge polarity of the toner is applied may also be employed. In that case, the set value in the case where the auxiliary separation rollers 41 are not raised may preferably be determined under a condition in which the image defect due to the separation electric discharge during the separation of the recording material.

Incidentally, a constitution in which a discharging member such as a discharging brush or the like for discharging the surface potential of the transfer belt 24 is disposed downstream of the separation roller 26 and upstream of the stretching roller 25 with respect to the movement direction of the transfer belt 24 may also be applied.

Next, an operation flow will be described with reference to FIG. 8.

When an image forming job for forming the image is inputted by the user, a selecting operation of the recording material conveyed with the image formation is performed and then the operation flow is started (S001). The controllers 50 reads the information on the basis weight of the recording material used for the image formation, i.e., the basis weight information of the recording material se by the user at a user operating portion 102 in this embodiment (S002). The basis weight is judged by the controller as to whether or not it is larger than 40 g/m$^2$ (S003). In the case where the basis weight of the recording material is 40 g/m$^2$ or less, in order to separate the recording material from the transfer belt 24, the operation for forming the projections by pushing up the transfer belt 24 by the auxiliary separation rollers 41. The auxiliary separation rollers 41 are moved in the Y1 direction and is disposed at the push-up position in which the transfer belt 24 is pushed up (S004). Next, a voltage applying operation to the pre-separation charger is started (S005). The controller 50 judges whether or not the leading end of the recording material P has reached the recording material guide 29 (S005). In this embodiment, a constitution in which an unshown recording material detecting sensor is provided to the recording material guide 29 is employed, and judgment as to whether or not the leading end of the recording material reaches the recording material guide 29 is made by this recording material detecting sensor. Without providing the recording material detecting sensor to the recording material guide 29, another method such that a time is counted from a predetermined point to detect the position of the recording material may also be employed. In the case where the leading end of the recording material reaches the recording material guide 29, the separation of the recording material is ended and therefore the voltage application to the pre-separation charger 60 is stopped (S007). On the other hand, in the case where the leading end of the recording material has not reached the recording material guide, the voltage application to the pre-separation charger 60 is continued. In the case where the leading end of the recording material has reached the recording material guide 29, the voltage application to the pre-separation charger 60 is stopped and the auxiliary separation rollers are moved to the accommodating position, so that the image formation is ended (S010). Here, stop timing of the pre-separation charger will be described. The separation of the recording material is most severe at the leading end portion. For that reason, when the leading end portion of the recording material is separated from the transfer belt 24, it is possible to ensure the separation property of the recording material. Therefore, in this embodiment, when the reaching of the leading end of the recording material to the recording material guide 29 can be detected, it is possible to judge that the recording material is separated from the transfer belt 24 and therefore on the basis of this point, the stop timing of the voltage application to the pre-separation charger 60 is determined.

On the other hand, in the case where the controller 50 judges that the basis weight of the recording material is larger than 40 g/m$^2$ in 5003, the voltage application to the pre-separation charger 60 is not performed (S009) and then the controller 50 disposes the auxiliary separation rollers at the accommodating position (S008). In this embodiment, the operation flow of the image forming operation per (one) sheet of the recording material but during continuous image formation, this operation flow is repeated.

Incidentally, the set value of the applied bias depends on charge retaining power of the recording material and therefore there is a need to consider these conditions. The charge retaining power of the recording material depends on a resistance value of the recording material and therefore there is a need to consider a change in moisture content of the recording material due to humidity (change) and the types (insulating sheet or plain paper) of the recording material. That is, when the humidity becomes high, the recording material resistance value is lowered and when a degree of insulation of the recording material becomes large, the recording material resistance value is lowered.

Thus, in the case where the recording material resistance value is low, the charge retaining power is poor and therefore a constitution in which a stronger applied bias is used may also be employed. Specifically, it is also possible to employ a constitution in which the applied bias is set at a large absolute value at a preset rate when a humidity detecting member is provided and the humidity is increased and a constitution in which the applied bias is set at the large absolute value at the preset rate when the insulating sheet is selected.

<Embodiment 2>

In the constitution in Embodiment 1, when the auxiliary separation device is operated on the basis of the type of the recording material, the preset voltage is applied to the pre-separation charger. On the other hand, this embodiment is characterized in that the voltage applied to the pre-separation charger is changed depending on the secondary transfer voltage.

Generally, the secondary transfer current value is fluctuated depending on various conditions (a drying state of paper, environment, a maximum charge density of the toner to be transferred, and the like) and therefore the amount of the charge of the recording material after passing through the secondary transfer portion fluctuates. When the recording material charge amount is decreased, the attracting force of the recording material to the transfer belt is weakened and thus the recording material is liable to be separated from the transfer belt during the wavy shape formation by the auxiliary separation device, so that improper separation is liable to occur. On the other hand, when the charge amount of the recording material P becomes excessively large, the attracting force of the recording material P to the transfer belt becomes excessively large. Thus, even when the waviness is provided on the recording material by the auxiliary separation device, the attracting force becomes larger than the strength of resilience of the recording material, so that the improper separation occurs. For that reason, in this embodiment, in consideration of the influence of the secondary transfer current, the attracting force of the recording material to the transfer belt when the auxiliary separation device is operated is intended to be set in a proper range.

Therefore, in this embodiment, in order to set the charge amount of the recording material P in the proper range, the voltage applied to the pre-separation charger is changed depending on the secondary transfer current, so that the charge amount of the recording material P is adjusted.

FIG. 9 is a graph showing a relationship between the secondary transfer current (absolute value) and the basis (absolute value) applied to the pre-separation charger. From this figure, when the secondary transfer current is small, the bias which has the same polarity as the normal charge polarity of the toner and which has a larger absolute value of the voltage is applied to the pre-separation charger.

That is, a constitution in which with respect to a first voltage value for the corona charger at a first secondary transfer current value, the voltage value for the corona charger is set at a second voltage value larger than the image voltage value when the current value becomes a second current value smaller than the first current is employed. Further, when the secondary transfer current value becomes large, the bias which has the same polarity as the normal charge polarity of the toner and which has a smaller absolute value of the voltage is applied to the pre-separation charger.

The relationship shown in FIG. 9 is obtained so that the attracting force which is preset after the transfer voltage application and the voltage application to the pre-separation charger under a condition in which the A4-sized recording material with the basis weight of 40 g/m$^2$ is passed and a solid white image is transferred onto the recording material can be obtained. The preset attracting force is obtained under a condition in which a maximum spacing amount between the recording material and the transfer belt when the auxiliary separation device is operated is 1 mm. Incidentally, this condition is an example and different setting may also be made depending on a range of the basis weight of the recording material to be separated.

In this embodiment, a table including such a relationship is stored in a memory portion, and a flow for determining the voltage applied to the pre-separation charger depending on a detection result, of the secondary transfer current value, inputted into the controller is included.

A control block diagram is shown in FIG. 10. To the block diagram in Embodiment 1, a portion where the current detected by a current detecting portion 13*a* is inputted into the controller 50 is added. Other portions are the same as those in the block diagram in Embodiment 1, thus being omitted from description.

Next, a flowchart will be described with reference to FIG. 11.

A portion added to the flowchart shown in FIG. 8 in Embodiment 1 will be explained. In this embodiment, a new step is provided between S004 and S005 in FIG. 8.

When the operation for moving the auxiliary separation rollers to the push-up position in 5004, in this embodiment, a value of the current passing through the leading end portion of the conveyed recording material, specifically an area of 0-10 mm is detected by the detecting portion 13*a* (S0040). Incidentally, this area is an example. Then, depending on a detection results of the detecting portion 13*a*, the bias applied by the pre-separation charger is determined (S0041). This bias is determined on the basis of the information, inputted into the memory portion, prepared from the relationship shown in FIG. 9. Then, the voltage is applied to the pre-separation charger (S005) and thereafter, the operation is performed in accordance with the flowchart shown in FIG. 8.

In this embodiment, the bias (voltage) applied to the pre-separation charger is determined by detecting the current value only at the leading end portion corresponding to a margin of the recording material. However, the current detecting area is not limited to the leading end portion but the same effect as that in this embodiment can be obtained even when the current detecting area is an image area.

<Embodiment 3>

In Embodiment 3, flowability of the developer in the developing device is detected and the value of the bias applied by the pre-separation charger is determined depending on the detected flowability of the developer, so that the amount of electric charge provided to the recording material is changed.

A degree of the image defect due to the electric discharge during the separation between the recording material P and the transfer belt 24 depends on the developer flowability. That is, when the flowability is high, the unfixed toner on the recording material is liable to move in an in-plane direction. Further, the electric charge provided to the recording material by the electric discharge has the same polarity to the normal charge polarity of the toner and thus the toner is liable to move in the in-plane direction by the Coulomb force acting between the toner and the electric charge provided to the recording material, so that the image is liable to disturbed.

Generally, the toner in the developing device is deteriorated depending on a rotation time of the screw and the flowability is also largely fluctuated. For that reason, by adjusting the bias applied by the pre-separation charger in consideration of the flowability, it is possible to minimize the image distribution on the recording material while ensuring the separation property of the recording material.

The toner flowability in the developing device is detected by detecting a torque of the screw, which is a conveying member for stirring and conveying the toner, by using a torque detecting means (FIG. 12). FIG. 12 is a schematic view showing a structure of a part of the developing device. A screw 70 for conveying the toner to a developing sleeve 72 which is a developer carrying member for developing the latent image formed on the photosensitive drum is provided. The screw 70 is rotated by being supplied with the driving force by a driving motor 71. In this embodiment, the toner flowability is discriminated by detecting the torque of the driving motor 71 for driving the screw 70.

With respect to the relationship between the toner flowability and the driving motor torque, the screw torque becomes large when the toner flowability is low and thus the current applied to the motor for rotating the screw becomes large. For that reason, a current fluctuation is monitored and is regarded as the change in flowability and then is reflected in the bias applied to the corona charger.

A control flow will be described. With respect to the bias applied to the pre-separation charger set in Embodiment 1, in the case of less than a predetermined torque, judgment that the toner flowability is high and thus there is a possibility of the occurrence of the image disturbance is made. As a result, in general, the bias which has the same polarity as the normal charge polarity of the toner and which has the absolute value of 5 kV is modified so that the absolute value is decreased so as to decrease the charge amount. In this embodiment, the absolute value is modified into 4.5 kV.

That is, in the case where the toner flowability is high, a constitution in which the voltage applied to the pre-separation charger set in Embodiment 1 or Embodiment 2 is modified so as to become a smaller voltage is employed. As described above, in this embodiment, the toner flowability judgment is made, in the case where the motor torque value is less than the preset value (first set value), so that the voltage is uniformly added by 0.5 kV to the absolute value of the determined voltage applied to the pre-separation charger. Further, in the case where the torque value the first set value or more, the absolute value of the determined voltage applied to the pre-separation charger is not modified.

Thus, in the case where the toner flowability is high, by modifying the value of the bias applied by the pre-separation charger, it is possible to reduce the degree of the image disturbance due to the electric discharge while ensuring the separation property of the recording material.

As described above, in a constitution in which the method of separating the recording material from the transfer belt by locally pushing up the transfer belt by the push-up means is used, irrespective of a magnitude of the transfer electric field at the transfer portion, the attraction property between the recording material and the transfer belt at the push-up separation portion can be enhanced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 235604/2010 filed Oct. 20, 2010, which is hereby incorporated by reference.

What is claimed is:

1. An image forming apparatus comprising:

an image bearing member;

a stretched rotatable belt member;

transfer means for forming a transfer portion for permitting transfer of a toner image from said image bearing member onto a recording material carried on said belt member;

a separation roller, capable of separating from said belt member the recording material carried on said belt member, for stretching said belt member;

push-up means capable of locally pushing up a belt surface, with respect to a widthwise direction of said belt member, located upstream of said separation roller and downstream of the transfer portion with respect to a rotational direction of said belt member to separate from said belt member the recording material carried on said belt member;

pre-separation charging means, located downstream of the transfer portion and upstream of said push-up means with respect to the rotational direction of said belt member, for electrically charging the recording material by being supplied with a bias of an identical polarity to a normal charge polarity of a toner; and an execution portion for executing an operation in a mode in which the recording material charged by said pre-separation charging means is separated from said belt member by pushing up said belt member by said push-up means.

2. An image forming apparatus according to claim 1, wherein when said push-up means does not push up said belt member, a voltage is not applied to said pre-separation charging means or a voltage which is lower than that when said push-up means pushes up said belt member is applied.

3. An image forming apparatus according to claim 1, wherein said pre-separation charging means charges the recording material to an identical polarity to the normal charge polarity of the toner.

4. An image forming apparatus according to claim 1, wherein an absolute value of the bias applied by said pre-separation charging means is increased with a decreasing absolute value of a transfer bias applied to said transfer means.

5. An image forming apparatus according to claim 1, further comprising torque detecting means for detecting a torque of a screw for conveying the toner, wherein control for changing the bias applied by said pre-separation charging means depends on a detected torque.

6. An image forming apparatus according to claim 1, wherein at a position in which said pre-separation charging means charges the recording material, said belt member is flat with respect to a widthwise direction of said transfer means.

7. An image forming apparatus according to claim 1, wherein said execution portion executes the operation in the mode when a thickness of the recording material is a predetermined value or less.

8. An image forming apparatus according to claim 1, further comprising:

fixing means for fixing the toner image on the recording material;

a guide portion, provided downstream of said separation roller with respect to a conveyance direction of the recording material, for guiding the recording material to said fixing means; and a control means for controlling a voltage application to said pre-separation charging means, wherein when said execution portion executes the operation in the mode, said control means stops the voltage application to said pre-separation charging means after a leading end of the recording material reaches said guide portion.

9. An image forming apparatus according to claim 1, wherein said push-up means is moved from a push-up position to a retracted position after voltage application to said pre-separation charging means is stopped.

* * * * *